US010225663B2

(12) United States Patent
Ikeda

(10) Patent No.: US 10,225,663 B2
(45) Date of Patent: Mar. 5, 2019

(54) MICROPHONE WITH A RESONATOR

(71) Applicant: AUDIO-TECHNICA CORPORATION, Machida-shi, Tokyo (JP)

(72) Inventor: Tatsuya Ikeda, Machida (JP)

(73) Assignee: AUDIO-TECHNICA CORPORATION, Machida-Shi, Tokyo (JP)

( * ) Notice: Subject to any disclaimer, the term of this patent is extended or adjusted under 35 U.S.C. 154(b) by 0 days.

(21) Appl. No.: 15/900,179

(22) Filed: Feb. 20, 2018

(65) Prior Publication Data

US 2018/0255403 A1 Sep. 6, 2018

(30) Foreign Application Priority Data

Mar. 6, 2017 (JP) ..... 2017-041657

(51) Int. Cl.
*H04R 19/04* (2006.01)

(52) U.S. Cl.
CPC ..... *H04R 19/04* (2013.01); *H04R 2410/07* (2013.01)

(58) Field of Classification Search
CPC .... H04R 19/04; H04R 2410/07; H04R 1/222; H04R 1/28; H04R 1/2807; H04R 1/2823; H04R 1/2838; H04R 1/2846
See application file for complete search history.

(56) References Cited

U.S. PATENT DOCUMENTS

2008/0089527 A1* 4/2008 Shou ..... H04R 19/04 381/67
2012/0195453 A1* 8/2012 Harano ..... H04R 19/04 381/356
2014/0288927 A1* 9/2014 Klug ..... G10L 21/0208 704/228
2015/0327810 A1* 11/2015 Horii ..... A61B 5/6833 600/586
2017/0026729 A1* 1/2017 Albers ..... G01L 9/0005

FOREIGN PATENT DOCUMENTS

JP H10-336777 A 12/1998
JP 2010-103604 A 5/2010

* cited by examiner

*Primary Examiner* — Mark Fischer
(74) *Attorney, Agent, or Firm* — Manabu Kanesaka

(57) ABSTRACT

A microphone includes a microphone case having an opening in front of the microphone case accommodating a microphone unit in the opening; a piece of double-sided adhesive tape whose back side is attached along the opening of the front side of the microphone case; and a filter adhered to a front side of the piece of the double-sided adhesive tape so as to cover the opening of the microphone case, wherein the piece of the double-sided adhesive tape is provided with sound introduction holes which introduces sound waves to the microphone unit through the filter. This configuration enables to provide a microphone easily and in a short time having desired frequency response characteristics without raising costs.

5 Claims, 4 Drawing Sheets

MICROPHONE WITH A RESONATOR

RELATED APPLICATIONS

The present application is based on, and claims priority from, Japanese Application No. JP2017-041657 filed Mar. 6, 2017, the disclosure of which is hereby incorporated by reference herein in its entirety.

BACKGROUND OF THE INVENTION

Field of the Invention

The present invention relates to a microphone having an acoustic resonator (hereinafter simply referred to resonator) in front of a diaphragm, in order to adjust frequency response mainly at high frequencies.

Description of the Related Arts

As means for adjusting frequency response at high frequencies, a microphone is provided in which a resonator is disposed in front of a diaphragm. The resonator is provided with sound introduction holes for the diaphragm, and combination of shapes, opening sizes, the number and arrangements of the sound introduction holes allow to adjust frequency response characteristics at high frequencies.

The resonator is made of metal materials or plastics, and is often attached by screwing to a front opening of a microphone case; an example of the resonator is disclosed in Patent Literature 1: Japanese Unexamined Patent Application Publication No. 2010-103604.

In a microphone where a resonator is disposed in front of the diaphragm, it is proposed that additional disposing of a sheet of foamed urethane (sponge) as a filter in front of the resonator enables to reduce popping noise and wind noise and further to prevent dust and dirt intrusion to a microphone unit; this is disclosed, for example, in a Patent Literature 2: Japanese Unexamined Patent Application Publication No. H10 (1998)-336777. The Patent Literature 2 discloses that a sheet of foamed urethane is adhered to a front surface of the resonator (also referred to an equalizer).

FIGS. 5A through 5C illustrate an example of employment to a condenser microphone of the microphone structure where foamed urethane as a filter material is disposed in front of a resonator disclosed in the Patent Literature 2. In the example illustrated in FIGS. 5A through 5C, a sheet of foamed urethane 2 is attached to a front face of a microphone case 1 formed to be a bottomed metal cylinder. FIG. 5B shows a piece of a double-sided adhesive tape 3 between the microphone case 1 and the foamed urethane viewed from a b-b viewing-plane line therebetween shown in FIG. 5A. FIG. 5C shows a resonator 1*e* with a plurality of sound introduction holes 1*f* provided on the microphone case 1, viewed from the b-b viewing-plane line.

The piece of the double-sided adhesive tape 3 is formed to be a ring shape and most part of the inner area is a circular opening 3*c*, as shown in FIG. 5B. The ring-shaped piece of the double-sided adhesive tape 3 is attached to a peripheral edge of the resonator 1*e* that is integrally formed with the microphone case 1. The sheet of foamed urethane 2 as a filter is attached with the piece of the double-sided adhesive tape to cover a front surface of the resonator 1*e*.

A microphone unit case 4 that accommodates a diaphragm (not shown) and a fixed electrode (not shown) being opposed to the back surface of the diaphragm is disposed right after the resonator 1*e* which is integrally formed with the microphone case 1.

The example shown in FIGS. 5A through 5C is the same as an embodiment according to the present invention that will be explained later shown in FIGS. 1A through 1C, except both the structure that the microphone case 1 is integrally formed with the resonator 1*e* and a shape of the double-sided adhesive tape 3.

The equivalently functional members are referred to the same reference numerals in FIGS. 5A through 5C and FIGS. 1A through 1C, and a detailed explanation will be given later with reference to FIGS. 1A through 1C.

SUMMARY OF THE INVENTION

In the microphone shown in FIGS. 5A through 5C, a plurality of sound introduction holes 1*f* is provided on the front surface of the microphone case 1 made of a metal bottomed-cylinder. A mold is required to prepare a resonator having the plurality of sound introduction holes 1*f* that is integrally formed with the microphone case 1.

A desired frequency response at high frequencies can be obtained by selecting a combination of a shape, opening size, number and arrangement of sound introduction holes 1*f* functioning as a resonator 1*e*. To respond to users' requirements, many kinds of resonators 1*e* are to be necessarily prepared, and many kinds of molds should accordingly be prepared, which may become a disadvantage that it takes time to produce various molds and it is inevitable to raise the cost.

The object of the invention is to provide a microphone including many kinds of resonators according to users' requirements easily and in a short time without preparing many kinds of molds and raising costs.

The microphone invented to overcome the above disadvantage is provided with a microphone case having an opening on a front side of the microphone case and accommodating a microphone unit inside the opening of the microphone case; a piece of a double-sided adhesive tape a back side of which is adhered over the opening of the microphone case; and a filter being adhered to a front side of the piece of the double-sided adhesive tape to cover the opening of the microphone case, wherein at least one sound introduction hole is formed on the piece of the double-sided adhesive tape for introducing sound waves to the microphone unit through the filter.

The piece of the double-sided adhesive tape functions as a resonator to adjust a frequency response at a specific frequency and is desirably provided with a plurality of sound introduction holes disposed at least in a circumferential direction. The filter functions to reduce a popping noise and a wind noise applied to the microphone unit.

According to the above configured microphone, a filter made of foamed urethane is adhered to cover the front opening of the microphone case with the piece of the double-sided adhesive tape. By forming sound introduction holes properly which introduces sound passed through the filter to the diaphragm, the piece of the double-sided adhesive tape can be made to have a function of a resonator capable of adjusting a frequency response at a specific frequency.

Thus, preparation of jigs or the like to form sound introduction holes on the piece of the double-sided adhesive tape enables to form a resonator having desired frequency response characteristics, and this enables to provide a microphone easily and in a short time having desired frequency response characteristics.

DESCRIPTION OF THE PREFERRED EMBODIMENTS

Figure 1A:
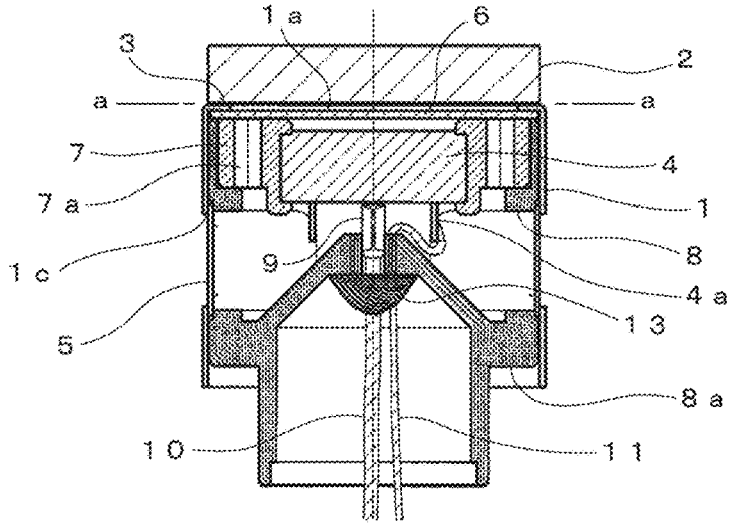
FIG. 1A is a vertical cross-sectional view of a microphone in accordance with an embodiment of the present invention.
Figure 5A:
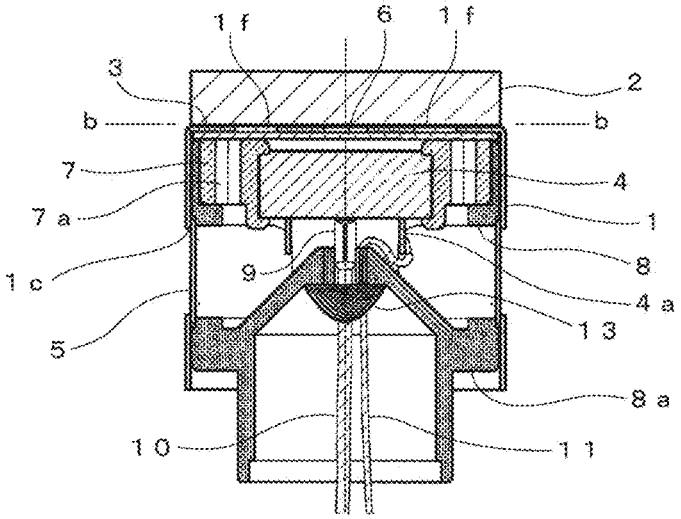
Fig. 5A Prior Art
FIG. 5A is a cross-sectional view of an example of a conventional microphone.

An embodiment of a microphone according to the present invention will be described with reference to drawings FIGS. 1A through 1C. As for the microphone, as a part of whose structure is already explained with reference to FIGS. 5A through 5C, a sheet of foamed urethane 2 as a filter is attached by means of a piece of a double-sided adhesive tape 3 on a front surface of the microphone case 1 having a cylindrical shape made of metal.

Figure 1B:
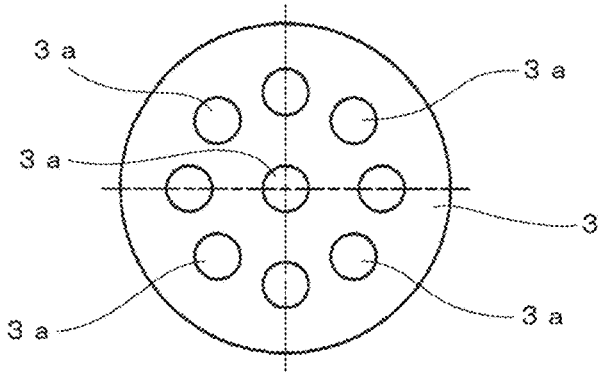
FIG. 1B is a front view of a double-sided adhesive tape viewed from a-a viewing-plane line in FIG. 1A.
Figure 1C:
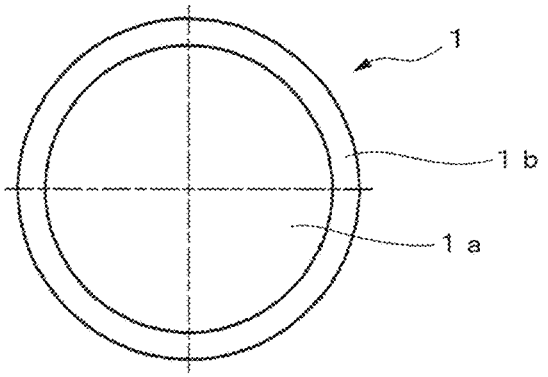
FIG. 1C is a front view of a microphone case viewed from a-a viewing-plane line in FIG. 1A.

The microphone case 1 has a circular opening 1*a* on a front side as shown in FIG. 1C and a ring-shaped edge surface 1*b* is formed between the opening 1*a* and a circumferential surface of the microphone case 1. A back side of the piece of the double-sided adhesive tape 3, shown in FIG. 1B, is stuck on the edge surface and a disk of foamed urethane 2 as the filter is further affixed to a front side of the piece of the double-sided adhesive tape 3.

A plurality of side openings 1*c* having a slit shape are formed on the circumferential surface of the microphone case 1, and a cylinder 5 made of mesh material is attached along the inside of the slit-shaped side openings 1*c*. The microphone of this embodiment configures a unidirectional condenser microphone and side openings 1*c* formed on the microphone case 1 comprise rear acoustic terminal holes.

The piece of the double-sided adhesive tape 3 has a plurality of sound introduction holes 3*a* shown in FIG. 1B. In this example, eight sound introduction holes are disposed at even intervals along the circumferential direction to surround the sound introduction hole disposed at the central region; all of the sound introduction holes are formed to be circular holes with the same diameter.

The piece of the double-sided adhesive tape 3 having plurality of sound introduction holes 3*a* functions as a resonator. When the sound wave arriving through the filter 2, a sheet of urethane foam, for example, acts on the microphone unit in the unit case 4 to be described later, the frequency response characteristics mainly in the high frequency range can be adjusted with the resonator. These sound introduction holes 3*a* function as front acoustic terminal holes of the unidirectional condenser microphone.

The foamed urethane 2 as the filter attached to be disposed on the front surface of the double-sided adhesive tape 3 functions to reduce popping noises due to air current caused by plosive sound of speakers and wind noises due to wind blowing, and further to prevent dust invasion into the microphone unit.

A front mesh 6, a mesh member, is disposed on the ring-shaped edge surface 1*b* in the microphone case 1, and a unit holder 7 made of soft rubber material which supports the unit case 4 at the center is disposed behind the front mesh 6. A plurality of communication holes 7*a* in an axial direction is formed in the unit holder 7, surrounding the unit case 4; the communication holes 7*a* communicate a front and rear area of the unit case 4 through the front mesh 6 and function to adjust the acoustic characteristics.

The unit holder 7 supporting the unit case 4 is attached to the microphone case 1 with a metal supporting member 8 that is disposed on the inner circumferential surface.

The unit case 4 is made of metal material, such as aluminium, and in which a diaphragm is disposed in front side and a fixed electrode behind the diaphragm to constitute a microphone unit.

A clip terminal 9 connected to a lead-out electrode rod protruding from the center of the unit case 4 is connected with a lead wire 10 for signal and a ground terminal 4*a* formed on the back side of the unit case 4 is connected with a lead wire 11 for grounding.

Each of the lead wires 10 and 11 is led out through a center hole that is formed in a rear member 8*a* being integrally formed with the supporting member 8 and is fixed with an adhesive 13 filling the central hole.

Figure 2:
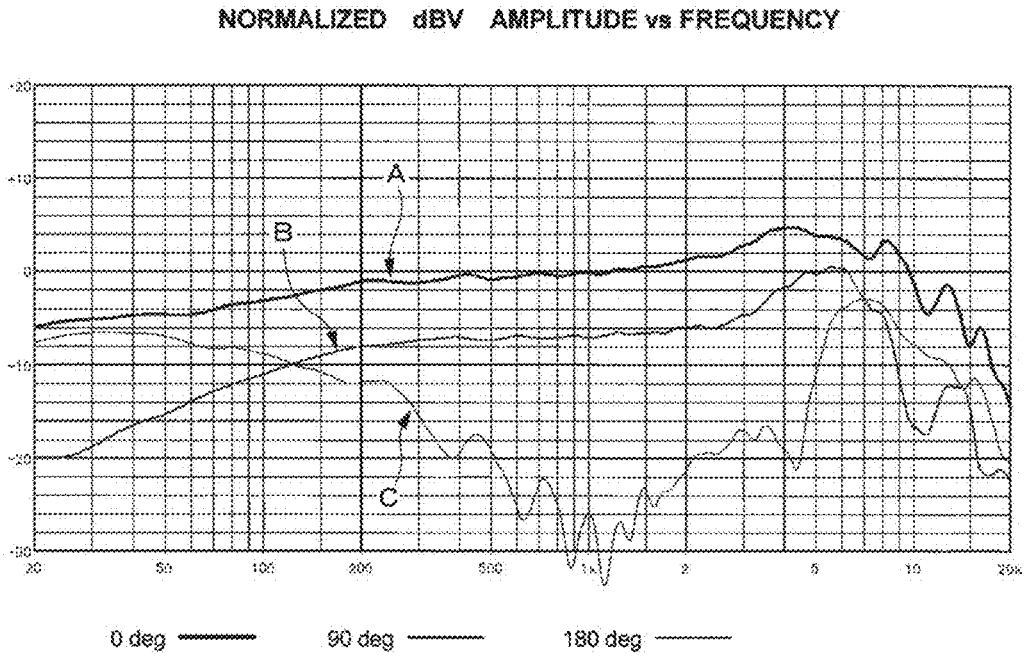
FIG. 2 is a graph showing a measured frequency response of the microphone shown in FIG. 1A.
Figure 3:
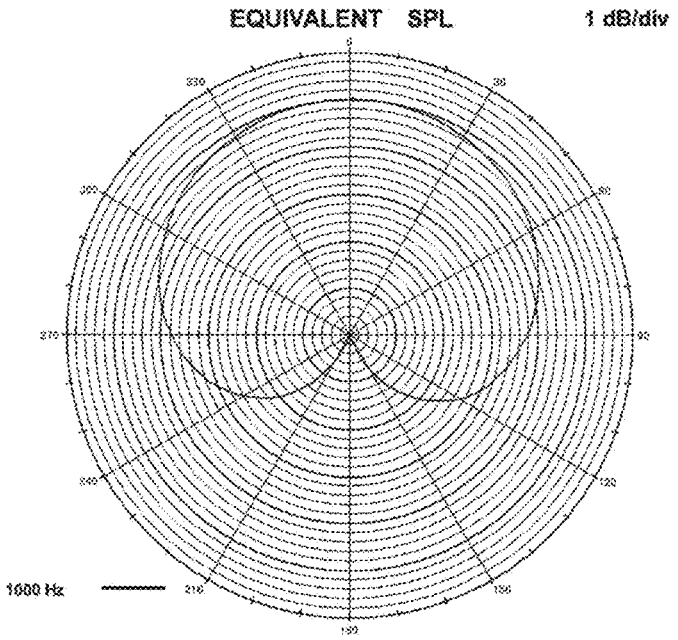
FIG. 3 is a graph showing a measured polar pattern of the microphone shown in FIG. 1A.

FIG. 2 shows the frequency response characteristics of the microphone according to the present invention shown in FIGS. 1A to 1C, and FIG. 3 shows a polar pattern at 1,000 Hz of the microphone.

The frequency characteristics shown in FIG. 2 is plotted with output level (dBV) as the vertical axis and frequency as the horizontal axis, as is generally employed. The characteristics A, B, and C correspond to frequency characteristics at 0 degrees, 90 degrees and 180 degrees with respect to the directional axis of the microphone, respectively.

Figure 4:
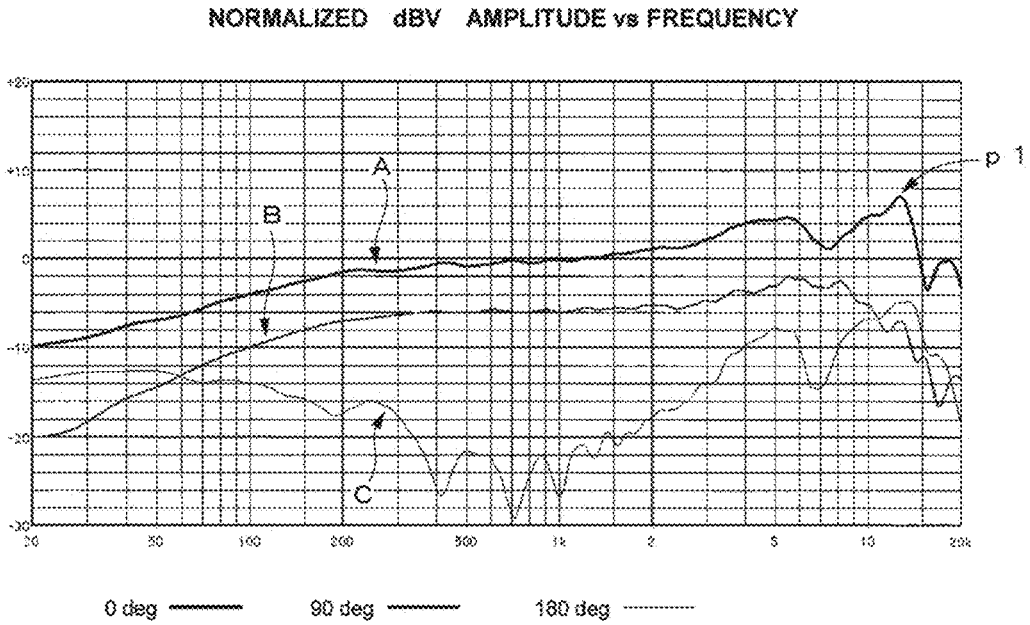
FIG. 4 is a graph showing a measured frequency response in a case where a large diameter opening at the central area of a piece of the double-sided adhesive tape, as an example for comparison.
Figure 5B:
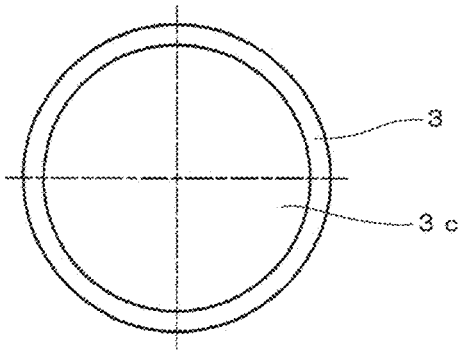
Fig. 5B Prior Art
FIG. 5B is a front view of the double-sided adhesive tape viewed from b-b viewing-plane line in FIG. 5A.
Figure 5C:
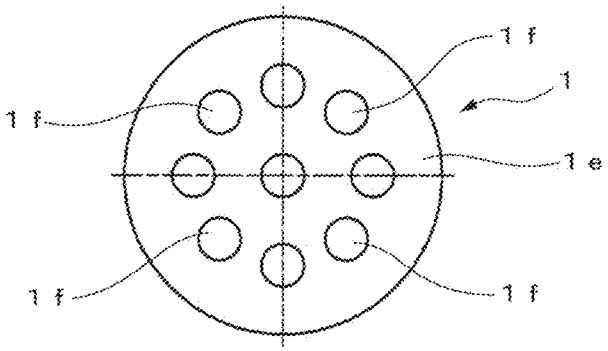
Fig. 5C Prior Art
FIG. 5C is a front view of the microphone case viewed from b-b viewing-plane line in FIG. 5A.

FIG. 4 is a comparative characteristics to the frequency response characteristics according to the present invention shown in FIG. 2; this shows frequency response characteristics for a case where a large diameter opening, which is similar to the opening 3*c* shown in FIG. 5B, is formed at the center of the piece of the double-sided adhesive tape to fail functioning as a resonator. Characteristics A, B, and C shown in FIG. 4 similarly correspond to frequency response characteristics at 0 degrees, 90 degrees and 180 degrees with respect to the directional axis of the microphone, respectively.

When attention is focused on the result of characteristics A at 0 degrees with respect to the directional axis in FIG. 4, which shows a case failing a resonator function, relatively high peak p1 appears at near 12 kHz. In contrast to this, the result of characteristics A at 0 degrees with respect to the directional axis in FIG. 2 shows that the peak p1 is effectively suppressed and the characteristics are improved to be more flattened, resulting easier listening. It is well understood from the above result that the piece of the double-sided adhesive tape 3 shown in FIG. 1B sufficiently performs the function of resonator.

As described above, in a microphone according to the present invention, the piece of the double-sided adhesive tape 3 having sound introduction holes 3*a* properly formed functions as a resonator, as well as an adhesive for fixing a sheet of foamed urethane as a filter, which enables to remarkably reduce the cost as compared to the conventional preparation of resonator using a mold.

And this enables to provide a microphone easily and in a short time having desired frequency response characteristics.

Although explanations are made of an example of a condenser microphone, this invention is similarly applicable to other types of microphone including a dynamic microphone, for example and a similar effect would be obtainable.

What is claimed is:

1. A microphone with a resonator, comprising:

a microphone case having one opening at a front side of the microphone case and accommodating a microphone unit in the opening;

a piece of a double-sided adhesive tape whose back side is attached to the front side of the microphone case; and a filter adhered to a front side of the piece of the double-sided adhesive tape so as to cover the opening of the microphone case, wherein the piece of the double-sided adhesive tape is provided with sound introduction holes through which sound waves are introduced to the microphone unit from the filter, and the piece of the double-sided adhesive tape functions as a resonator to adjust a frequency response at a high frequency.

2. The microphone according to claim 1, wherein the piece of the double-sided adhesive tape is provided with a plurality of sound introduction holes that are disposed at least in a circumferential direction.

3. The microphone according to claim 1, wherein the filter functions to reduce a popping noise and wind noise to occur to the microphone.

4. The microphone according to claim 1, wherein the sound introduction holes include a center hole and a plurality of circumferential holes disposed around the center hole with even intervals along a circumference thereof, the center hole and the plurality of circumferential holes having diameters same as each other, and the one opening has a diameter larger than that of each of the sound introduction holes.

5. The microphone according to claim 4, further comprising a mesh member disposed between the piece of the double-sided adhesive tape and the microphone case, wherein the microphone unit includes a plurality of communication holes penetrating in an axial direction, and front and rear sides of the microphone unit are communicated through the mesh member and the plurality of communication holes to adjust acoustic characteristics.

* * * * *